US007446709B2

(12) United States Patent
Ishimiya

(10) Patent No.: US 7,446,709 B2
(45) Date of Patent: Nov. 4, 2008

(54) ANTENNA DEVICE AND MOBILE TERMINAL APPARATUS EQUIPPED WITH THE ANTENNA DEVICE

(75) Inventor: Katsunori Ishimiya, Tokyo (JP)

(73) Assignee: Sony Ericsson Mobile Communications Japan, Inc. (JP)

( * ) Notice: Subject to any disclaimer, the term of this patent is extended or adjusted under 35 U.S.C. 154(b) by 26 days.

(21) Appl. No.: 11/314,025

(22) Filed: Dec. 22, 2005

(65) Prior Publication Data

US 2006/0176223 A1 Aug. 10, 2006

(30) Foreign Application Priority Data

Feb. 4, 2005 (JP) ..... 2005-029364

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 4,367,474 | A | 1/1983 | Schaubert et al. | |
| 6,140,966 | A * | 10/2000 | Pankinaho | 343/700 MS |
| 6,421,014 | B1 * | 7/2002 | Sanad | 343/700 MS |
| 6,717,548 | B2 * | 4/2004 | Chen | 343/700 MS |
| 2004/0051673 | A1 | 3/2004 | Moren et al. | |
| 2004/0227680 | A1 * | 11/2004 | Wen et al. | 343/725 |
| 2004/0246182 | A1 * | 12/2004 | Chen et al. | 343/700 MS |
| 2007/0040751 | A1 * | 2/2007 | Boyle | 343/702 |

FOREIGN PATENT DOCUMENTS

| | | | |
|---|---|---|---|
| EP | 1 498 984 | A1 | 1/2005 |
| JP | 2001-130619 | | 5/2001 |
| JP | 2001-136019 | A | 5/2001 |
| KR | 2003060502 | A * | 7/2003 |
| WO | WO-2004/030143 | A1 | 4/2004 |
| WO | WO-2004/109847 | A1 | 12/2004 |

OTHER PUBLICATIONS

European Search Report mailed on May 24, 2006.

* cited by examiner

*Primary Examiner*—Douglas W Owens
*Assistant Examiner*—Dieu Hien T Duong
(74) *Attorney, Agent, or Firm*—Rader Fishman & Grauer PLLC; Ronald P. Kananen

(57) ABSTRACT

There is provided an antenna device which has an antenna element having a predetermined resonant frequency characteristic; and support means for supporting said antenna element. In the antenna device, the support means has at least three electrical connection holes for providing electrical connection to the antenna element, and one desired electrical connection hole from among the electrical connection holes is connected to a feed point, and one desired electrical connection hole from among the electrical connection holes except the electrical connection hole connected to the feed point being connected to ground so that the antenna element is adjustable in resonant frequency characteristic.

7 Claims, 5 Drawing Sheets

ANTENNA DEVICE AND MOBILE TERMINAL APPARATUS EQUIPPED WITH THE ANTENNA DEVICE

CROSS REFERENCES TO RELATED APPLICATIONS

The present document contains subject matter related to Japanese Patent Application JP 2005-029364 filed in the Japanese Patent Office on Feb. 4, 2005, the entire contents of which being incorporated herein by reference.

BACKGROUND OF THE INVENTION

1. Field of the Invention

The present invention relates to an antenna device suitable for application to mobile terminal equipment such as mobile phones, PHS phones (PHS: Personal Handyphone System) and PDA equipment (PDA: Personal Digital Assistant) having communication functions, and relates to a mobile terminal apparatus equipped with such an antenna device. More particularly, the present invention relates to an antenna device which is constructed so that its corresponding characteristic (antenna characteristic) can be easily adjusted, and a mobile terminal apparatus equipped with such an antenna device.

2. Description of Related Art

Japanese Patent Application Publication (KOKAI) No. 2001-130619 (page 4: FIG. 1) has heretofore disclosed an inverted F antenna which permits fine adjustment of its resonant frequency.

The inverted F antenna includes an antenna section which has a feed terminal connected to a radiating device and first and second frequency switching terminals, and the frequency switching terminals are respectively first and second switches controlled by a control circuit. The control circuit performs switching control of the first switch to connect the first frequency switching terminal to ground directly or via an inductor, thereby enabling switching between resonant frequencies.

In addition, the control circuit performs switching control of the second switch to connect the second frequency switching terminal to ground or open the second frequency switching terminal, thereby enabling switching between further resonant frequencies. The inverted F antenna permits the resonant frequencies to be changed through inductance or the like, so that the inverted F antenna enables fine adjustment of the resonant frequencies and permits an arbitrary frequency to be selected from neighboring frequencies.

SUMMARY OF THE INVENTION

However, the inverted F antenna disclosed in the above-cited document needs the first and second switching terminals, the inductor and the first and second switches as well as complicated switching control of the control circuit in order to enable fine adjustment of the resonant frequencies. As a result, there is a problem that the inverted F antenna needs a complicated circuit construction and a space for installation of the above-mentioned components, and hinders miniaturization of an apparatus provided with the inverted F antenna.

The present invention has been made in view of the above-mentioned problem, and there is provided an antenna device whose resonant frequency can be adjusted without a substantial need for a special component or an installation space, as well as a mobile terminal apparatus equipped with such an antenna device.

To solve the above-mentioned problem, an antenna device according to an embodiment of the present invention includes an antenna element having a predetermined resonant frequency characteristic and support means for supporting the antenna element, the support means having at least three electrical connection holes for providing electrical connection to the antenna element.

One desired electrical connection hole from among the electrical connection holes of the support means is connected to a feed point and one desired electrical connection hole from among the electrical connection holes except the electrical connection hole connected to the feed point is connected to ground so that the antenna element is adjustable in resonant frequency characteristic.

To solve the above-mentioned problem, an antenna device according to an embodiment of the present invention includes an antenna element formed of a member having flexibility and a support frame for supporting the antenna element, the support frame having at least three electrical connection holes for providing electrical connection to the antenna element.

One desired electrical connection hole from among the electrical connection holes of the support frame is connected to a feed point and one desired electrical connection hole from among the electrical connection holes except the electrical connection hole connected to the feed point is connected to ground so that the antenna element is adjustable in resonant frequency characteristic.

To solve the above-mentioned problem, a mobile terminal apparatus according to an embodiment of the present invention includes: an antenna device including an antenna element formed with a plurality of antenna element pieces integrally connected to one another, each of which has a different resonant frequency characteristic as well as flexibility, and support means having at least three electrical connection holes for providing electrical connection to the antenna element, one desired electrical connection hole from among the electrical connection holes being connected to a feed point and one desired electrical connection hole from among the electrical connection holes except the electrical connection hole connected to the feed point being connected to ground so that the antenna element is adjustable in resonant frequency characteristic; a plurality of signal processing systems for performing signal processing on signals having different resonant frequencies to which the respective antenna element pieces correspond; branching filter means for separating signals received by the antenna device into signals having the different resonant frequencies to which the respective antenna element pieces correspond; and switching means for performing, during reception, switching between the signals separated by the branching filter means and supplying each of the signals to a respective one of the signal processing systems corresponding to the different resonant frequencies, and for performing, during transmission, switching between the signals having the different resonant frequencies processed by the respective signal processing systems and supplying each of the signals to the antenna device via the branching filter means.

According to the embodiment of the present invention, it is only necessary to select two electrical connection holes corresponding to a desired frequency characteristic from among the electrical connection holes provided in the support means or the support frame and connect one of the two electrical connection holes to the feed point and the other to ground. Accordingly, it is possible to easily adjust the resonant frequencies, and it is also possible to realize the antenna device without a substantial need for a special component or an installation space.

BRIEF DESCRIPTION OF THE DRAWINGS

The present invention will become more readily appreciated and understood from the following detailed description of embodiments of the present invention when taken in conjunction with the accompanying drawings, in which.

DETAILED DESCRIPTION OF THE PREFERRED EMBODIMENTS

The present invention can be applied to mobile phones.

[General Construction of Mobile Phone]

Figure 1:
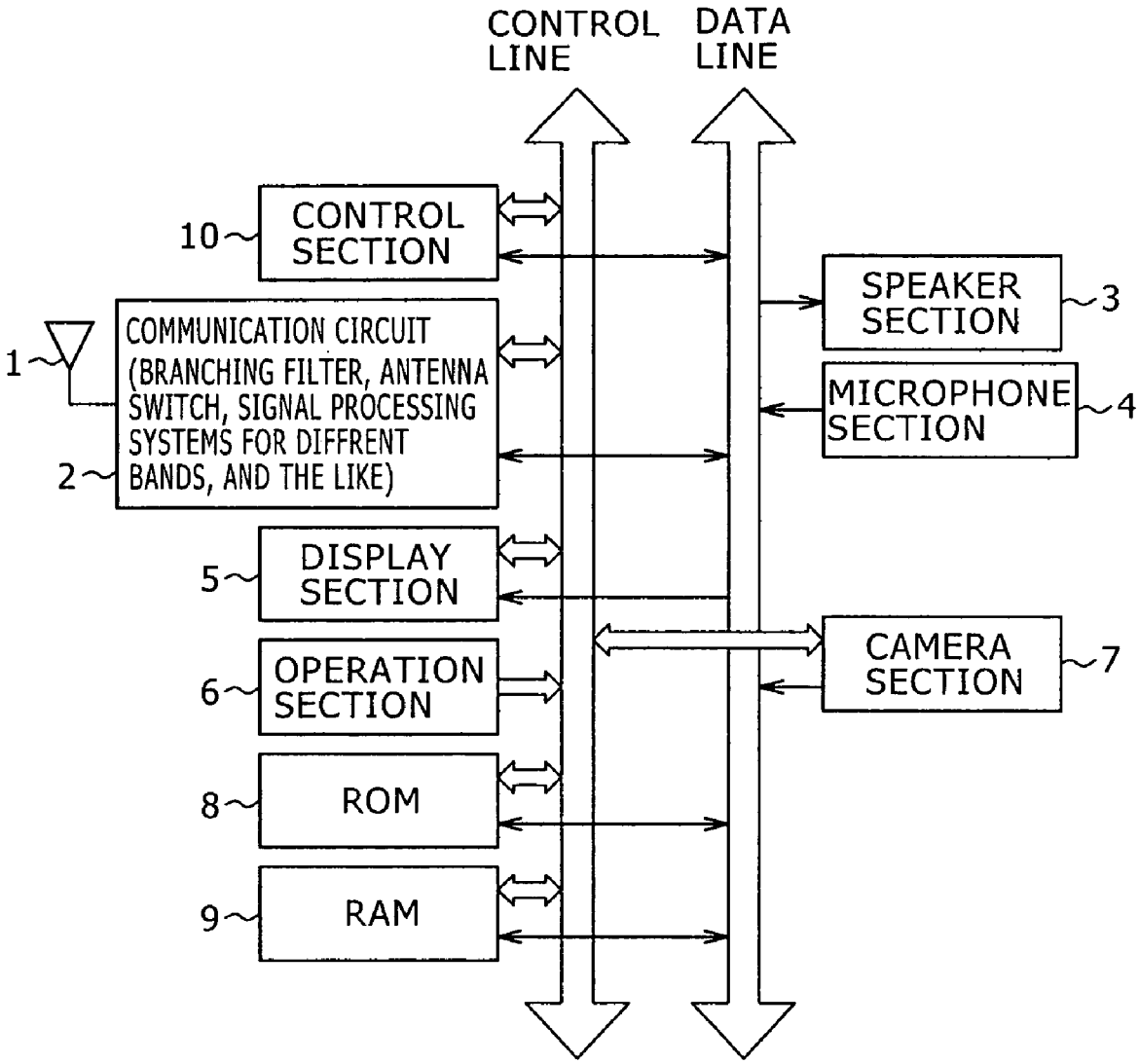
FIG. 1 is a block diagram of a mobile phone according to an embodiment to which the present invention is applied.

FIG. 1 shows a block diagram of a mobile phone according to an embodiment of the present invention. As shown in FIG. 1, the mobile phone according to the embodiment includes an antenna 1, a communication circuit 2, a speaker section 3, a microphone section 4 and a display section 5. The antenna 1 and the communication circuit 2 perform transmission and reception of data to and from a base station which is connected to a communications network of a mobile operator. The speaker section 3 provides an audio output such as a ringtone, a received voice, the sound of a video file, or the sound of music data. The microphone section 4 collects a voice or the like to be transmitted, and the display section 5 displays outgoing and incoming call numbers, the names of users who are sources and destinations, a log of incoming and outgoing calls and mobile mails, a telephone directory, an address book, a schedule book, the text of a sent or received mobile mail, and the like.

The mobile phone also includes an operation section 6, a camera section 7, a ROM 8, a RAM 9 and a control section 10. The operation section 6 is provided with a plurality of keys for performing input and the like of desired phone numbers and characters. The camera section 7 captures still images and video images of desired subjects. The ROM 8 stores a communication processing program (communication program) and various other application programs for performing information processing on the mobile mail and the schedule book. The RAM 9 stores the log of incoming and outgoing calls and mobile mails, the body of the sent or received mobile mail, the telephone directory, the address book, the schedule book, and the like. The control section 10 controls the operation of the mobile phone on the basis of the communication processing program and the various other application programs.

[Construction of Antenna]

Figure 2:
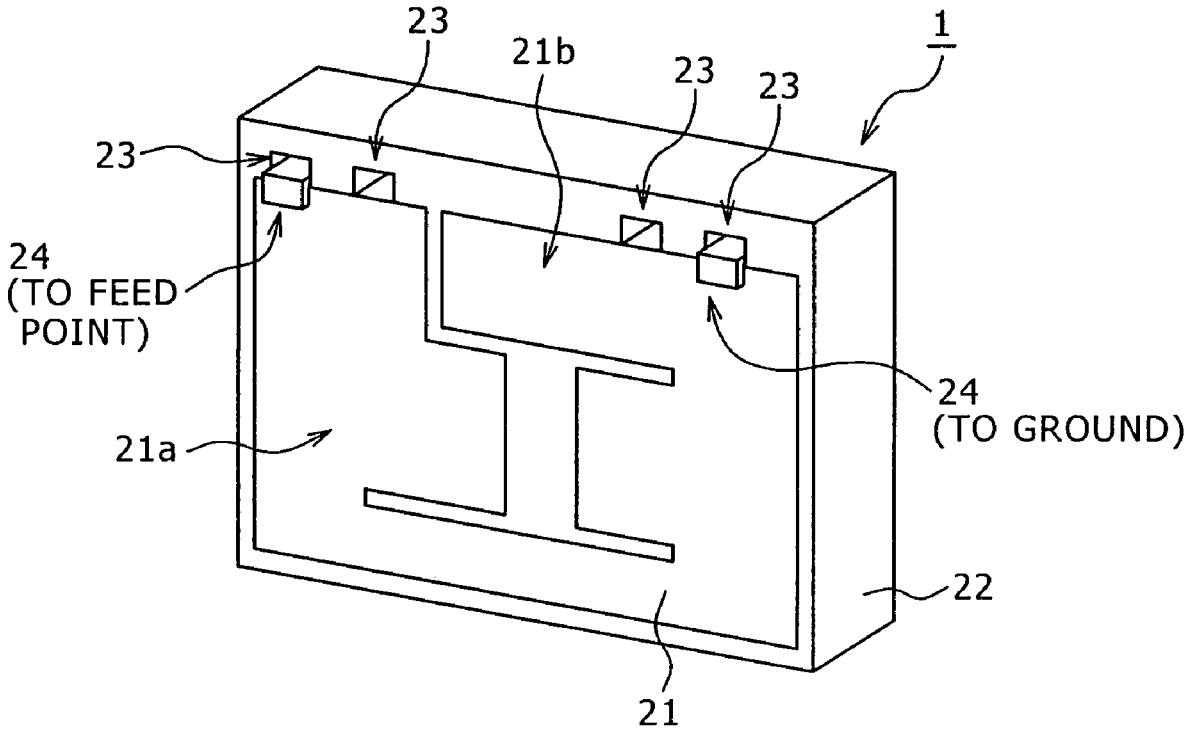
FIG. 2 is a schematic view showing the construction of an antenna provided in the mobile phone according to the embodiment of the present invention.

The antenna 1 is an inverted F antenna in this case. As shown in FIG. 2, the antenna 1 includes an antenna element 21 formed of a member having flexibility, and a support frame 22 supporting the antenna element 21.

The support frame 22 has at least three electrical connection holes 23 for enabling adjustment of the resonant frequency characteristic (antenna characteristic) of the antenna 1, and in the case of the antenna 1 shown in FIG. 2, four electrical connection holes 23 are provided by way of example. Two electrical connection holes 23 are selected from among the four electrical connection holes 23 according to a desired resonant frequency characteristic, and one of the selected two electrical connection holes 23 is connected to a feed point via a connection pin 24 for ensuring electrical continuity, while the other is connected to ground via another pin 24.

In the case of the example shown in FIG. 2, the right-side and left-side electrical connection holes 23 as viewed in FIG. 2 are selected, and the left-side electrical connection hole 23 is connected to the feed point via the connection pin 24, while the right-side electrical connection holes 23 is connected to ground via the connection pin 24. In addition, the connection pin 24 serves the function of fixing the antenna element 21 to the support frame 22.

The antenna element 21 is formed, for example, in such a manner that a first antenna element 21*a* and a second antenna element 21*b* are integrally connected to each other, and the antenna elements 21*a* and 21*b* function in a combined manner so as to correspond to a plurality of bands (multiband operation). Specifically, the first antenna element 21*a* is adapted to generally correspond to the 900 MHz and 1800 MHz bands, while the second antenna element 21*b* is adapted to generally correspond to the 1900 MHz band.

The antenna pattern of the antenna element 21 shown in FIG. 2 is merely one example, and other antenna patterns may be used to realize the same resonant frequency characteristic.

[Function of Antenna]

The function of the antenna 1 provided in the mobile phone according to the embodiment will be described below. The antenna 1 shown in FIG. 3 has an antenna pattern different from that of the antenna 1 shown in FIG. 2, but similarly to the antenna 1 shown in FIG. 1, the first antenna element 21*a* is adapted to correspond to the 900 MHz and 1800 MHz bands and the second antenna element 21*b* is adapted to correspond to the 1900 MHz band.

Figure 3:
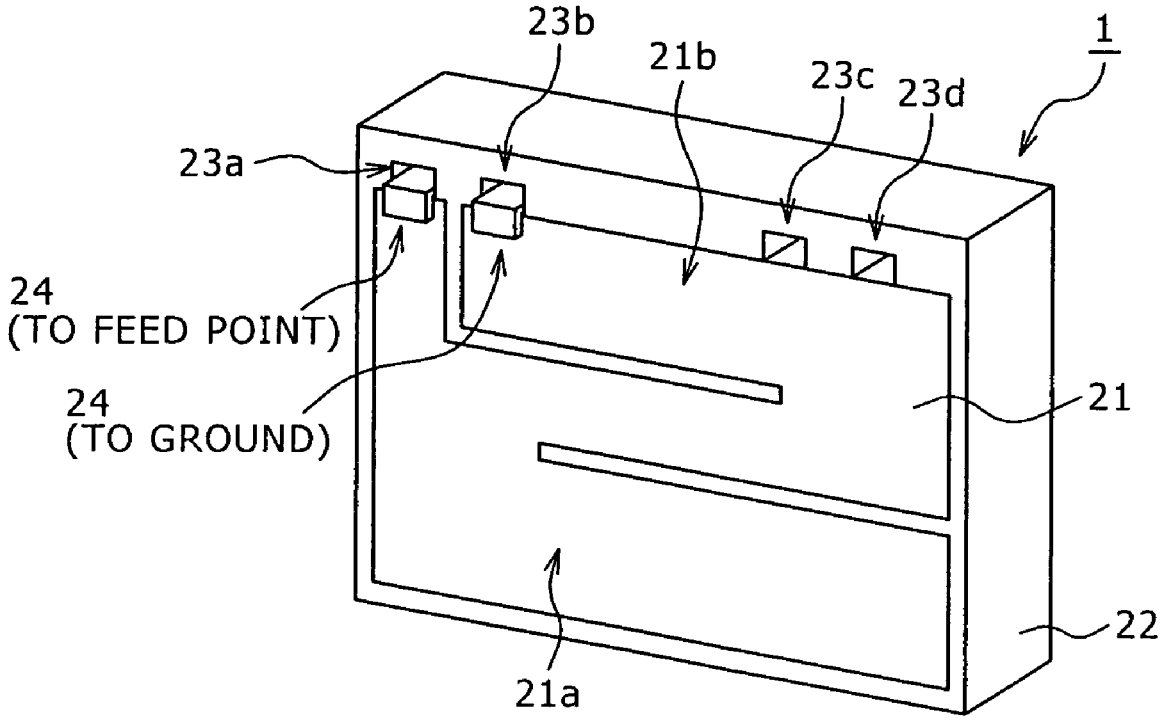
FIG. 3 is a schematic view showing the antenna before adjustment of the antenna characteristic thereof.

First, it is assumed that initial settings are configured so that an electrical connection hole 23*a* located at the left end as viewed in FIG. 3 and an adjacent electrical connection hole 23*b* are selected and a desired antenna characteristic is obtained by connecting the electrical connection hole 23*a* to the feed point via the connection pin 24 and connecting the electrical connection hole 23*b* to ground via the connection pin 24.

However, there is a case where a deviation occurs between a resonant frequency to be obtained by selecting the electrical connection hole 23*a* and the electrical connection hole 23*b* and an actually obtained resonant frequency for the reason that, for example, as a result of a later design change, the external shape of the mobile phone is modified or a case is formed out of a reinforced plastic member although the case has been planned to be formed out of an aluminum member. In this, the electrical connection holes 23 to be selected are changed as shown in FIG. 4 by way of example.

Figure 4:
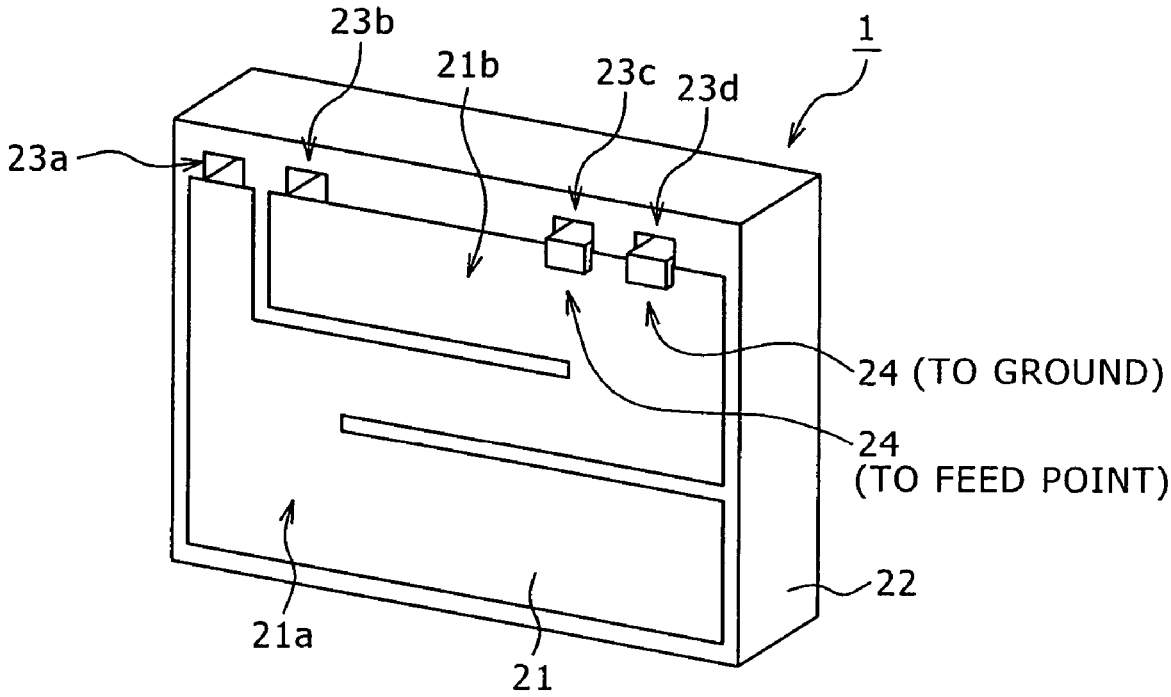
FIG. 4 is a schematic view showing the antenna after adjustment of the antenna characteristic thereof.

In the example shown in FIG. 4, the electrical connection holes 23 to be selected are changed from the electrical connection holes 23*a* and 23*b* to electrical connection holes 23*c* and 23*d*, and from between the newly selected electrical connection holes 23*c* and 23*d*, the electrical connection hole 23*c* is connected to the feed point via the connection pin 24, while the electrical connection hole 23*d* is connected to ground via the connection pin 24. In this manner, the resonant frequency characteristic of the antenna 1 is changed.

Figure 5:
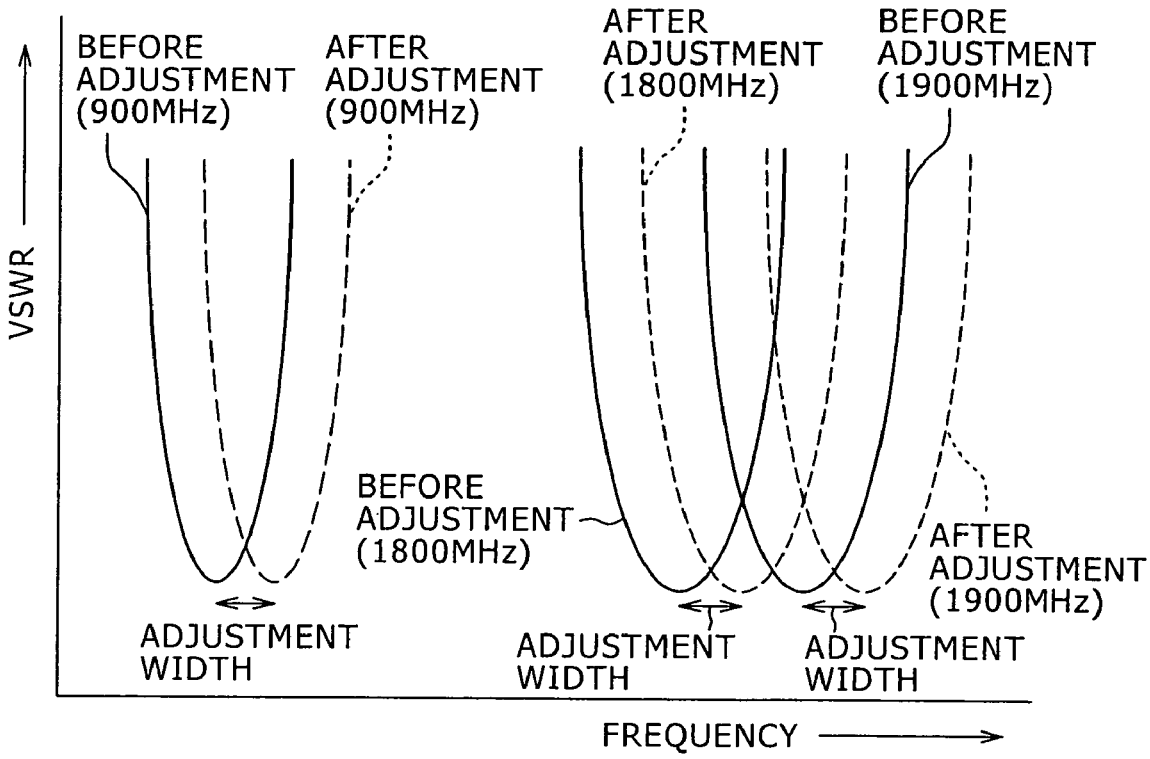
FIG. 5 is a diagram showing the frequency characteristics of the antenna provided in the mobile phone according to the embodiment of the present invention.

FIG. 5 has a horizontal axis indicative of frequencies and a vertical axis indicative of voltage standing wave ratios (VSWR), and each graph of a quadratic curve indicates a frequency characteristic of a respective one of the bands before and after adjustment. Specifically, in FIG. 5, graphs of quadratic curves shown by solid lines respectively indicate the frequency characteristics of the 900/1800 MHz band and the 1900 MHz band, while graphs of quadratic curves shown by dotted lines respectively indicate the frequency characteristics of the 900/1800 MHz band and the 1900 MHz band.

As can be seen from the graphs of FIG. 5, the resonant frequency characteristic of the antenna 1 is changed by changing the electrical connection holes 23 to be selected. Accordingly, the mobile phone according to the embodiment makes it possible to easily change and adjust a band to which the antenna 1 is to correspond, by changing the electrical connection holes 23 to be selected.

[Transmission and Reception Processing for Signals]

The antenna 1 corresponds to signals in the 900/1800 MHz band and signals in the 1900 MHz band as mentioned above. Signals received by the antenna 1 in each of the bands are separated into signals in the 800 MHz band, the 900 MHz band and the 1500 MHz band by a branching filter which is provided in the communication circuit 2 of the mobile phone. These signals are switched by an antenna switch and are supplied to signal processing systems for the respective bands, in each of which the supplied signals are subjected to appropriate signal processing.

During transmission of signals in the 900 MHz band, signals from the signal processing system for the 900 MHz band are selected by the antenna switch, and during transmission of signals in the 1800 MHz band, signals from the signal processing system for the 1800 MHz band are selected by the antenna switch, as well as during transmission of signals in the 1900 MHz band, signals from the signal processing system for the 1900 MHz band are selected by the antenna switch. These signals selected in this manner are transmitted to a base station via the branching filter and the antenna 1.

Effect of the Preferred Embodiment

As is apparent from the foregoing description, the mobile phone according to the embodiment of the present invention is constructed to select two electrical connection holes 23 corresponding to a desired frequency characteristic, from among the electrical connection holes 23 provided in the support frame 22 of the antenna 1, and one of the two selected electrical connection holes 23 is connected to the feed point and the other is connected to ground so that the antenna characteristic of the antenna 1 is adjusted to the desired frequency characteristic.

The antenna 1 has a construction in which the selected electrical connection holes 23 need only to be respectively connected to the feed point and ground, so that the antenna characteristic of the antenna 1 can be easily adjusted without a substantial need for a special component or an installation space.

Accordingly, even if a deviation occurs between an initially designed frequency characteristic and an actually obtained frequency characteristic due to factors such as a change of the external shape or members of the mobile phone and a change of the position of a magnet provided in an apparatus, the mobile phone makes it possible to rapidly and easily adjust the antenna characteristic according to the deviation between the frequency characteristics.

In addition, since the antenna characteristic can be adjusted, the antenna 1 having the same shape can be applied to various equipment handling different frequencies. Accordingly, the antenna 1 can be applied to a plurality kinds of equipment, so that it is possible to eliminate the waste of newly designing and producing a mold for each apparatus.

In addition, since the antenna characteristic can be adjusted, the antenna 1 can be subject to changes of frequency characteristics, members, shapes, component mounting positions or the like until just before the mass production of the mobile phone is started.

In addition, since the antenna characteristic can be adjusted, a desired antenna characteristic can be selected, so that the degree of freedom of the mobile phone can be increased.

[Modification]

In the above description of the preferred embodiment, the antenna 1 is assumed to correspond to the 900/1500 MHz band and the 1900 MHz band, but may also be appropriately modified to correspond to other bands such as the 800 MHz band and the 1500 MHz band.

In the above description of the embodiment of the present invention, the antenna element 21 is assumed to be formed of a flexible member, but may also be formed of MIDs (Molded Interconnect Devices), sheet metal, or the like.

Although the antenna 1 corresponds to a multiband construction, the antenna 1 may also be adapted to a single-band construction corresponding to one band. In this case as well, it is possible to adjust a band to which the antenna 1 is to correspond, by changing the electrical connection holes 23 to be selected.

In the above description of the embodiment of the present invention, reference has been made to an example in which the present invention is applied to mobile phones, but the present invention may also be applied to PHS phones (PHS: Personal Handyphone System) and PDA equipment (PDA: Personal Digital Assistant) having communication functions as well as other terminal equipment such as notebook personal computers having communication functions.

According to the present invention, it is only necessary to select two electrical connection holes corresponding to a desired frequency characteristic from among electrical connection holes provided in support means or a support frame and connect one of the two electrical connection holes to a feed point and the other to ground. Accordingly, it is possible to easily adjust a resonant frequency characteristic (antenna characteristic), and it is also possible to realize an antenna device without a substantial need for a special component or an installation space.

Accordingly, even if a deviation occurs in the frequency characteristic of an apparatus due to a factor such as an apparatus in which an antenna device according to the present invention is to be provided, the external shape and members of a mobile terminal apparatus according to the present invention, or the position of a magnet provided in an apparatus, it is possible to adjust the antenna characteristic according to the deviation in the frequency characteristic.

In addition, since the antenna characteristic can be adjusted, an antenna device having the same shape can be applied to various equipment handling different frequencies. Accordingly, the antenna device can be applied to a plurality kinds of equipment, so that it is possible to eliminate the waste of newly designing and producing a mold for each apparatus.

In addition, since the antenna characteristic can be adjusted, the antenna device can be subject to changes of frequency characteristics, members, shapes, component mounting positions or the like until just before the mass production of mobile terminal equipment is started.

In addition, since the antenna characteristic can be adjusted, a desired antenna characteristic can be selected, so that it is possible to increase the degree of freedom of an apparatus in which the antenna device according to the embodiment of the present invention is to be provided, and the degree of freedom of a mobile terminal apparatus according to the embodiment of the present invention.

The above-mentioned embodiments are merely disclosed as one example of the present invention. It goes without saying that the present invention is not limited to the above-mentioned embodiments, and can of course be modified in various ways other than the above-mentioned embodiments according to design and the like without departing from technical concepts according to the present invention.

It should be understood by those skilled in the art that various modifications, combinations, sub-combinations and alterations may occur depending on design requirements and other factors insofar as they are within the scope of the appended claims or the equivalents thereof.

What is claimed is:

1. A mobile terminal apparatus comprising:

an antenna device including:

an antenna element formed with a plurality of antenna element pieces integrally connected to one another, each of which has a different resonant frequency characteristic as well as flexibility, and support means having at least three electrical connection holes for providing electrical connection to said antenna element, one desired electrical connection hole from among said electrical connection holes being connected to a feed point and another desired hole from among said electrical holes being connected to ground so that said antenna element is adjustable in resonant frequency characteristic;

a plurality of signal processing systems for performing signal processing on signals having different resonant frequencies to which said respective antenna element pieces correspond;

branching filter means for separating signals received by said antenna device into signals having said different resonant frequencies to which said respective antenna element pieces correspond; and switching means for performing, during reception, switching between said signals separated by said branching filter means and supplying each of said signals to a respective one of said signal processing systems corresponding to said different resonant frequencies, and for performing, during transmission, switching between said signals having said different resonant frequencies processed by said respective signal processing systems and supplying each of said signals to said antenna device via said branching filter means.

2. An antenna device comprising:

an antenna element, wherein said antenna element includes a first antenna element and a second antenna element;

a support frame adapted to support said antenna element, wherein said support frame includes a plurality of electrical connection holes extending into said support frame;

a feed connection pin; and a ground connection pin;

wherein a resonant frequency characteristic of said antenna element is at a first resonant frequency characteristic when said feed connection pin is electrically connected to a feed point of said first antenna element through a first one of said electrical connection holes and when said ground connection pin is electrically connected to a ground point of said second antenna element through a second one of said electrical connection holes, wherein said resonant frequency characteristic is different than said first resonant frequency characteristic when said feed connection pin is electrically connected to said feed point of said first antenna element through a third one of said electrical connection holes and when said ground connection pin is electrically connected to said ground point of said second antenna element through a fourth one of said electrical connection holes;

wherein said feed point and ground point are located on the same edge of the antenna element.

3. The antenna device according to claim 2, wherein said first and second antenna elements are integrally connected to one another.

4. The antenna device according to claim 2, wherein said antenna element is a member having flexibility.

5. The antenna device according to claim 2, wherein said feed point connection pin fixes said antenna element to said support frame.

6. The antenna device according to claim 2, wherein said ground connection pin fixes said antenna element to said support frame.

7. A mobile terminal apparatus comprising:

the antenna device according to claim 2; and signal processing systems adapted to performing signal processing on signals having different resonant frequencies to which said first and second antenna elements correspond.

* * * * *